US009969547B2

(12) United States Patent
Whittaker

(10) Patent No.: US 9,969,547 B2
(45) Date of Patent: May 15, 2018

(54) EXPANDABLE HOLDING TANK

(71) Applicant: Gregory A. Whittaker, Grande Prairie (CA)

(72) Inventor: Gregory A. Whittaker, Grande Prairie (CA)

( * ) Notice: Subject to any disclaimer, the term of this patent is extended or adjusted under 35 U.S.C. 154(b) by 0 days. days.

(21) Appl. No.: 14/942,057

(22) PCT Filed: Dec. 12, 2013

(86) PCT No.: PCT/CA2013/050954
§ 371 (c)(1),
(2) Date: Nov. 16, 2015

(87) PCT Pub. No.: WO2014/183189
PCT Pub. Date: Nov. 20, 2014

(65) Prior Publication Data

US 2016/0130077 A1 May 12, 2016

(30) Foreign Application Priority Data

May 16, 2013 (CA) ..... 281577

(51) Int. Cl.

| | |
|---|---|
| ***B65D 88/00*** | (2006.01) |
| ***B65D 88/12*** | (2006.01) |
| ***B65D 90/04*** | (2006.01) |
| ***B65D 90/16*** | (2006.01) |

(52) U.S. Cl.
CPC ..... *B65D 88/005* (2013.01); *B65D 88/126* (2013.01); *B65D 90/046* (2013.01); *B65D 90/16* (2013.01); *B65D 2590/046* (2013.01)

(58) Field of Classification Search
CPC ..... B65D 88/00; B65D 88/005; B65D 88/12; B65D 88/121; B65D 88/126; B65D 88/128; B65D 88/16; B65D 88/22; B65D 90/04; B65D 90/046; B65D 90/16; B65D 90/24; B65D 2590/046; B65D 90/02
USPC ..... 206/386; 220/1.5, 1.6, 4.12, 4.21, 4.28, 220/8, 564, 666, 681
See application file for complete search history.

(56) References Cited

U.S. PATENT DOCUMENTS

| | | | |
|---|---|---|---|
| 4,488,752 A | 12/1984 | Broussard | |
| 4,711,257 A | 12/1987 | Kobayashi | |
| 5,044,866 A | 9/1991 | Harp | |

(Continued)

FOREIGN PATENT DOCUMENTS

| | | | |
|---|---|---|---|
| CA | 2070939 A1 * | 12/1993 | ..... B65D 90/24 |
| CA | 2776171 A1 | 7/2013 | |

(Continued)

*Primary Examiner* — Bryon Gehman
(74) *Attorney, Agent, or Firm* — Davis & Bujold PLLC; Michael J. Bujold

(57) ABSTRACT

An expandable holding tank includes a base supporting a first sidewall to define a liquid retaining enclosure. A second sidewall travels up and down one of an exterior face or an interior face of the first sidewall from a stored position to an operative position. In the stored position, the second sidewall is nested with the first sidewall to position a lower edge of the second sidewall adjacent to the base. In the operative position, the second sidewall is telescopically extended relative to the first sidewall to place the lower edge of the second sidewall at a distance from the base and an upper edge of the second sidewall extending above an upper edge of the first sidewall.

14 Claims, 8 Drawing Sheets

(56) References Cited

U.S. PATENT DOCUMENTS

| | | | | |
|---|---|---|---|---|
| 5,170,901 | A | 12/1992 | Bersani | |
| 6,026,685 | A | 2/2000 | Weterrings et al. | |
| 6,112,929 | A | 9/2000 | Ota | |
| 6,302,475 | B1 | 10/2001 | Anderson | |
| 6,896,307 | B2 | 5/2005 | Nye et al. | |
| 7,404,580 | B2 | 7/2008 | Michael | |
| 9,248,775 | B2 * | 2/2016 | McGowen | B65D 88/005 |
| 2003/0047561 | A1 * | 3/2003 | Neto | B65D 90/046 220/1.6 |
| 2008/0179324 | A1 | 7/2008 | McGough et al. | |
| 2010/0025407 | A1 | 2/2010 | Benson | |
| 2010/0074723 | A1 | 3/2010 | Lancon | |
| 2010/0147860 | A1 | 6/2010 | McKenzie | |
| 2012/0255957 | A1 | 10/2012 | McGowen | |
| 2013/0334222 | A1 | 12/2013 | Elliot et al. | |
| 2015/0008218 | A1 * | 1/2015 | Lupul | B65D 88/005 220/8 |

FOREIGN PATENT DOCUMENTS

| | | | |
|---|---|---|---|
| GB | 1250313 | | 10/1971 |
| JP | H0733192 | A | 2/1995 |
| WO | 2010022347 | A2 | 2/2010 |

* cited by examiner

EXPANDABLE HOLDING TANK

FIELD

There is described an expandable holding tank that was developed for holding liquids.

BACKGROUND

In the oil industry, holding tanks are used to hold a variety of liquids at remote well sites. These holding tanks must be transported, usually by truck, to the remote well sites. There will hereinafter be described a holding tank that was developed to facilitate transportation to remote sites.

SUMMARY

There is provided an expandable holding tank which includes a base supporting a first sidewall to define a liquid retaining enclosure. The first sidewall has an exterior face, an interior face, an upper edge and a lower edge. A second sidewall is positioned adjacent to the first sidewall. The second sidewall has an exterior face, an interior face, an upper edge and a lower edge. The second sidewall travels up and down one of the exterior face or the interior face of the first sidewall from a stored position to an operative position. In the stored position the second sidewall is nested with the first sidewall to position the lower edge of the second sidewall adjacent to the base. In the operative position the second sidewall is telescopically extended relative to the first sidewall to place the lower edge of the second sidewall at a distance from the base and the upper edge of the second sidewall extending above the upper edge of the first sidewall. A leakage barrier is provided to prevent leakage between the first sidewall and the second sidewall. A stop is provided to selectively maintain the second sidewall in the operative position.

The expandable holding tank, as described above, may be transported with the second sidewall in the stored position. This provides the expandable holding tank with a profile of a smaller tank during transportation. When at a remote side, the second sidewall is moved from the stored position to the operative position. In the operative position, the second sidewall increases the height and, thereby, increases the capacity of the enclosure.

Movement of the second sidewall from the stored position to the operative position can be accomplished in various ways. With a first embodiment, which will hereinafter be described, it is envisaged that lifting equipment available on site, could be used to lift the second sidewall to the operative position. With a second embodiment, which will be hereinafter be described, a drive mechanism is built into the expandable holding tank. The drive mechanism is capable of mechanically lifting the second sidewall. The drive mechanism illustrated is a scissor lift. It will be appreciated that other forms of drive mechanisms could have been used.

There are different ways to avoid water leakage from the enclosure when the second sidewall is raised to the operative position. The first embodiment has a seal between a top edge of the first sidewall and a lower edge of the second sidewall. The second embodiment has a liquid retaining flexible liner suspended from the upper edge of the second sidewall and depending into the enclosure.

It is preferred that a removable cover be supported by the upper edge of the second sidewall, as a safety measure for personnel and to prevent unwanted debris getting into the enclosure.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
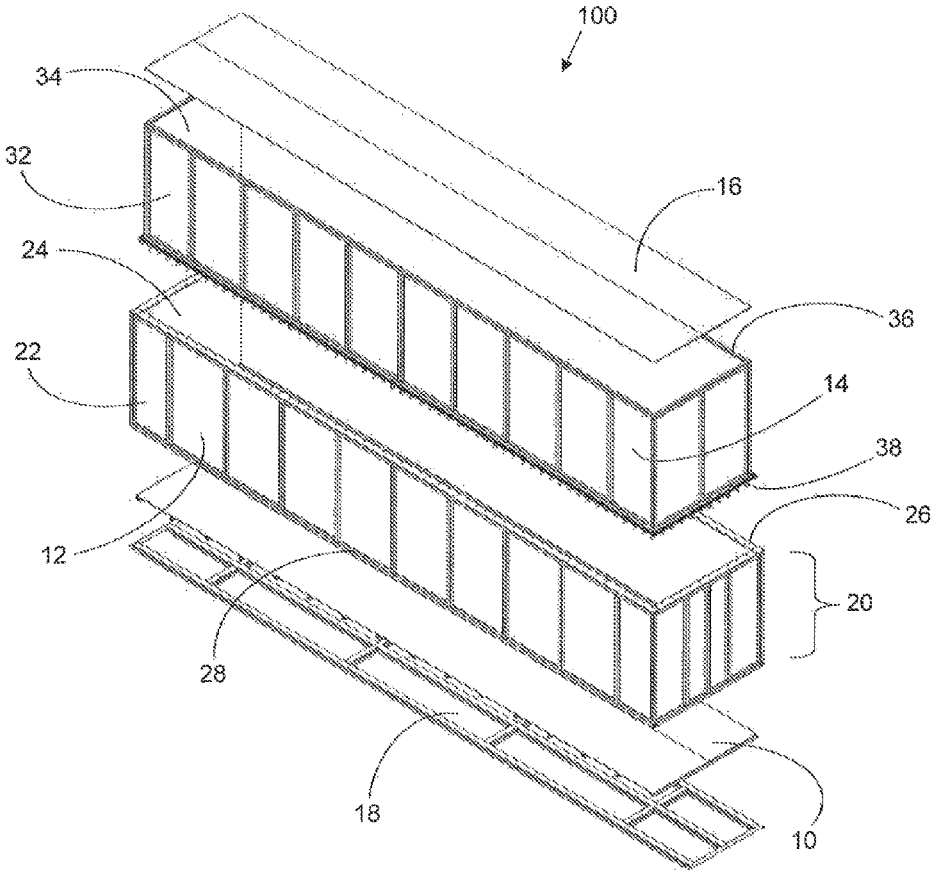
FIG. 1 is an exploded perspective view of an expandable holding tank.

A first embodiment of expandable holding tank generally identified by reference numeral 100, will now be described with reference to FIG. 1 through FIG. 5. A second embodiment of expandable holding tank generally identified by reference numeral 200, will then be described with reference to FIG. 6 through FIG. 8 in order to identify variations.

Structure and Relationship of Parts:

Referring to FIG. 1, the key components of expandable holding tank 100 are a base 10, a first sidewall 12 and a second sidewall 14. Desirable, but optional components, are a removable cover 16 and a transport skid 18.

Figure 2:
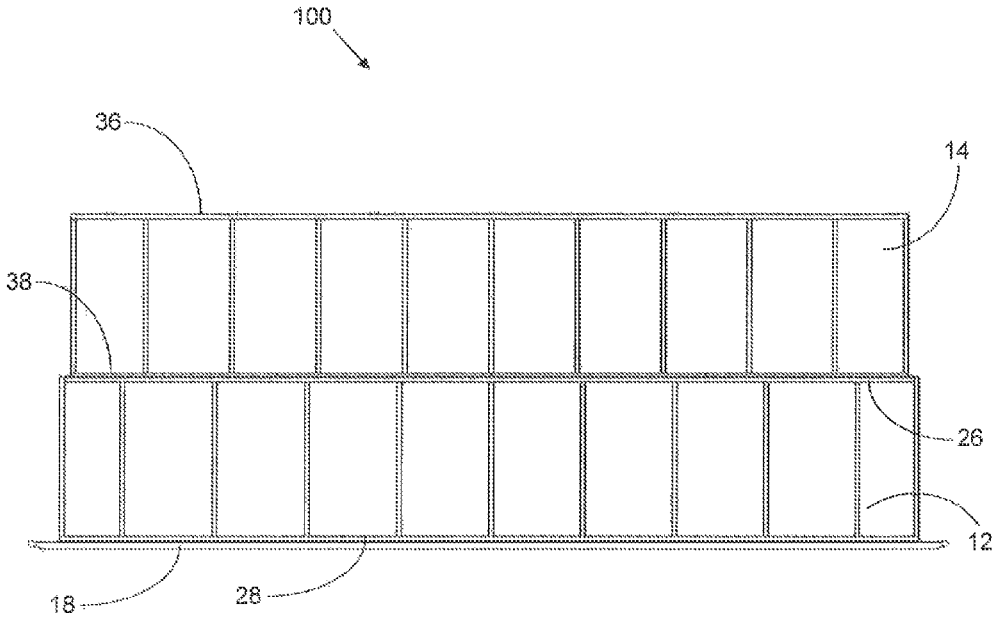
FIG. 2 is a side elevation view of the expandable holding tank illustrated in FIG. 1 in an operative position.
Figure 3:
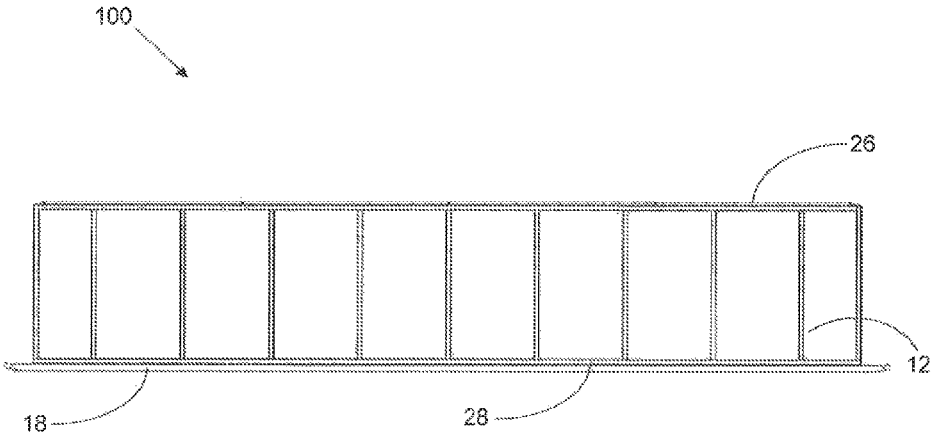
FIG. 3 is a side elevation view of the expandable holding, tank illustrated in FIG. 1 in a stored position.

Referring to FIG. 1, base 10 supports first sidewall 12 to define a liquid retaining enclosure 20. First sidewall 12 has an exterior face 22, an interior face 24, an upper edge 26 and a lower edge 28. Second sidewall 14 is positioned adjacent to first sidewall 12 in a telescopic relationship. Second sidewall 14 has an exterior face 32, an interior face 34, an upper edge 36 and a lower edge 38. Referring to FIG. 2 and FIG. 3, second sidewall 14 travels up and down interior face 24 of first sidewall 12 from a stored position illustrated in FIG. 2 to an operative position illustrated in FIG. 3. In the stored position, second sidewall 14 is nested with first sidewall 12 to position lower edge 38 of second sidewall 14 adjacent to base 10. In the operative position, second sidewall 14 is telescopically extended relative to first sidewall 12 to place lower edge 38 of second sidewall 14 at a distance from base 10 and upper edge 36 of second sidewall 14 extending above upper edge 26 of first sidewall 12.

Figure 5:
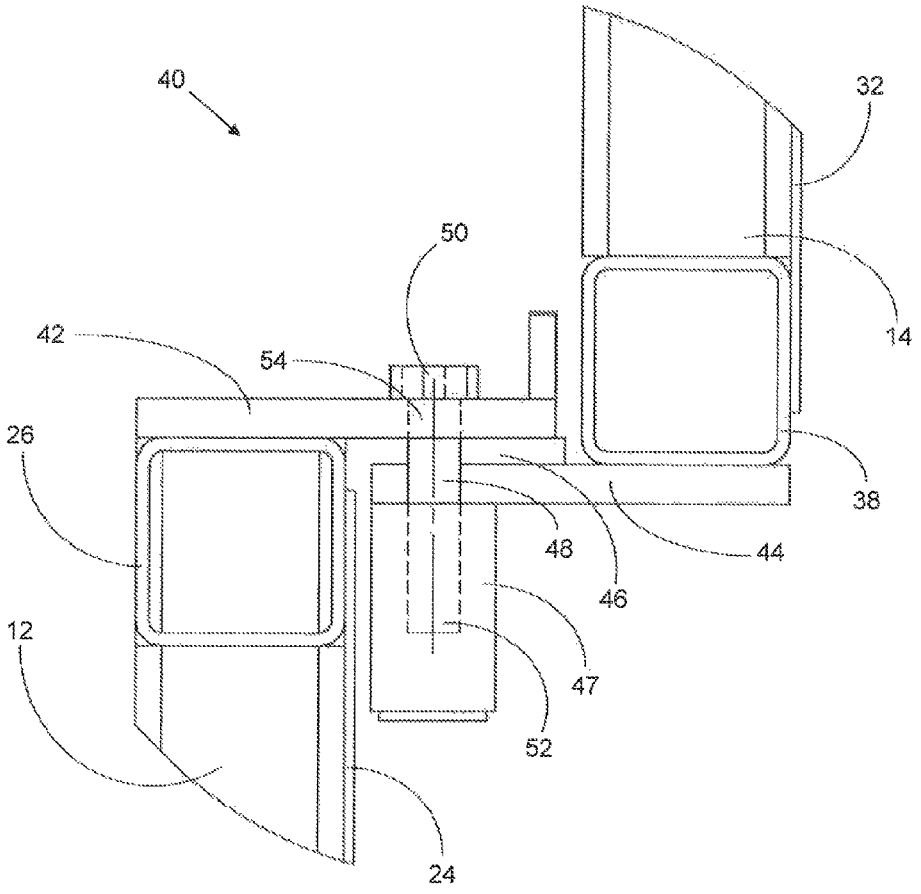
FIG. 5 is a section view of showing locking and sealing detail for the expandable holding tank illustrated in FIG. 4.

Referring to FIG. 5, a leakage harrier, generally identified by reference numeral 40, is provided to prevent leakage between first sidewall 12 and second sidewall 14. In first embodiment 100, leakage barrier 40 includes a continuous peripheral first seal component 42 positioned along or in proximity to upper edge 26 of first sidewall 12. A continuous peripheral second seal component 44 is positioned along or in proximity to lower edge 38 of second sidewall 14. When second sidewall 14 is raised to the operative position, second peripheral seal component 44 is brought into sealing engagement with first peripheral seal component 42 to form leakage barrier 40. First seal component 42 and second seal component 44 are both "continuous" and "peripheral" "Continuous" in the sense that there are no gaps left through which liquid may leak. Peripheral in the sense that a a peripheral band of sealing coverage is provided to interior face 24 of first sidewall 12 and exterior face 32 of second sidewall 14. As will hereafter be explained, first seal component 42 and second seal component 44 are made of metal. It is, therefore, preferred that a sealing gasket 46 be positioned between first seal component 42 and second seal component 44.

Figure 4:
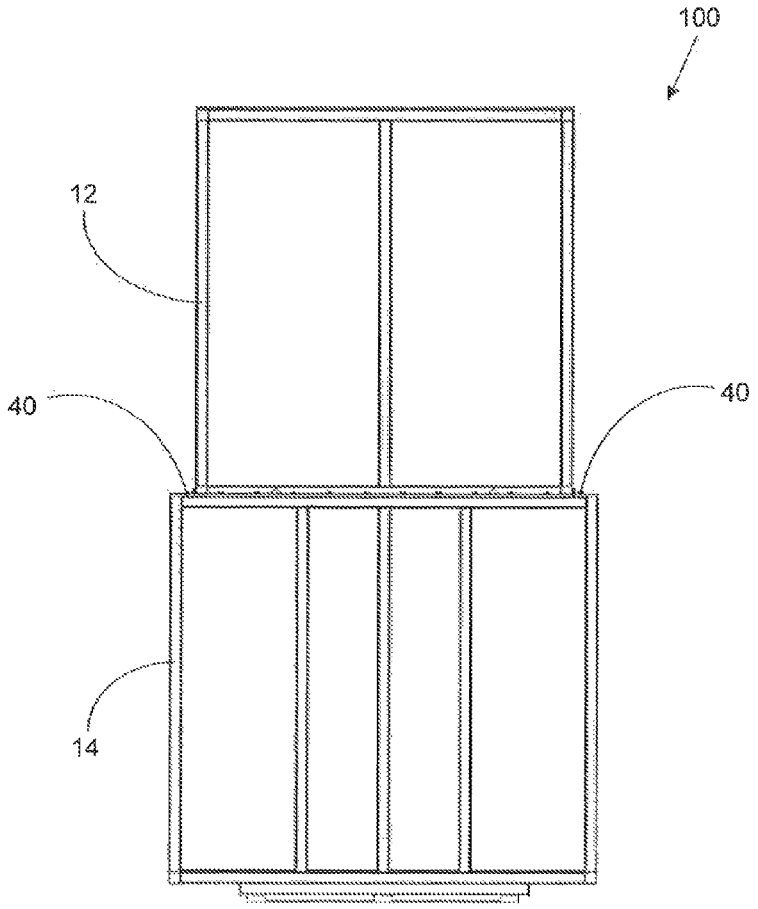
FIG. 4 is an end elevation view of the expandable holding tank illustrated in FIG. 1.

Some form of means must be provided to raise second sidewall 14 from the stored position illustrated in FIG. 3 to the operative position illustrated in FIG. 2 and FIG. 4. With first embodiment 100, lifting equipment available on site is used to lift the second sidewall to the operative position. In order to maintain second sidewall 14 in the raised position some form of stop must be used. Referring to FIG. 5, first seal component 42 and second seal component 44 have been made of metal and form mating structural flanges capable of bearing the load of second sidewall 14. Second seal component 44 has been provided with threaded fastener receptacles 46. Threaded fasteners 48 are provided, each of which has a head 50 and a threaded shaft 52. First seal component 42 has openings 54 that are large enough to allow threaded shah 52 to pass, but which are not large enough to allow head 50 to pass. Threaded shafts 52 of threaded fasteners 48 are extended through openings 54 to engage threaded fastener receptacles 46. The engagement by a plurality of fasteners spaced at intervals along a periphery of serves as a stop to selectively maintain second sidewall 14 in the operative position.

For reasons of safety and to prevent debris from falling into enclosure 20, removable cover 16 is supported by upper edge 36 of second sidewall 14. In order to facilitate transport to site, loading and unloading, base 10 is mounted on transport skid 18.

Operation:

Referring to FIG. 3, first embodiment 100 is transported to a remote side in the stored position. This is an advantage, as there are legal height restrictions on loads in some municipalities. It also avoids possible problems with clearance when going under underpasses and under power lines. Referring to FIG. 2 and FIG. 4, once first embodiment is on site and placed in position, second sidewall 14 is raised to the operative position. This is accomplished with lifting equipment on site. Referring to FIG. 5, second seal component 44 is brought into engagement with first seal component 42; sealing gasket 46 first being positioned between second seal component 44 and first seal component 42 to improve the sealing integrity of the seal. First seal component 42 and second seal component 42 serve as structural flanges capable of supporting the weight of second sidewall 14. Threaded shafts 52 of threaded fasteners 48 are extended through openings 54 in first seal component 42 to engage threaded fastener receptacles 46 of second seal component 44.

Figure 6:
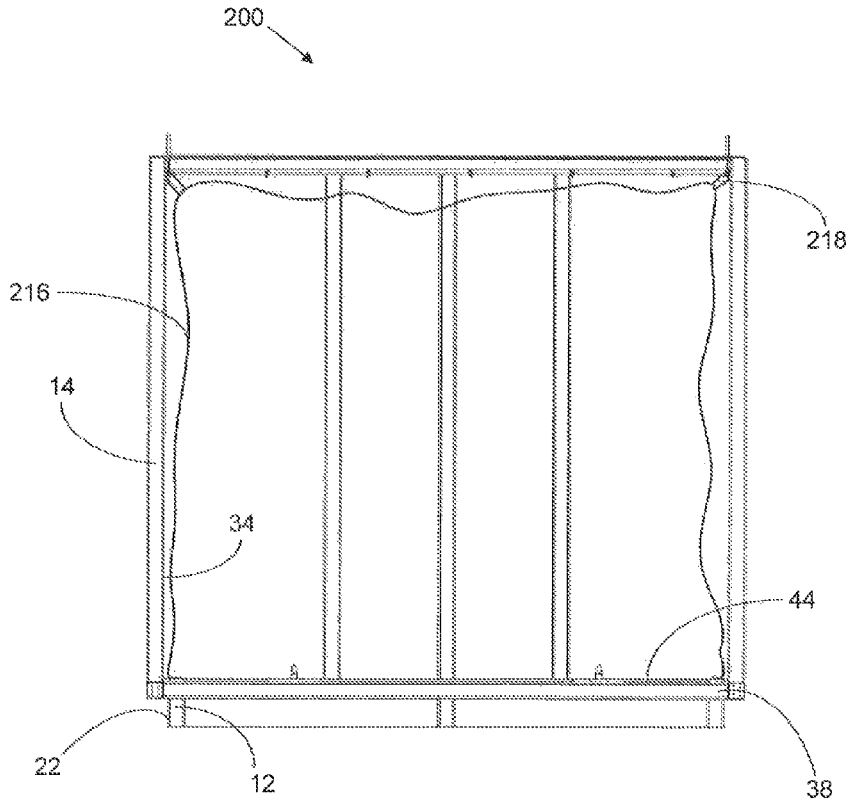
FIG. 6 is an end elevation view of an alternative embodiment of expandable holding tank in a stored position.
Figure 7:
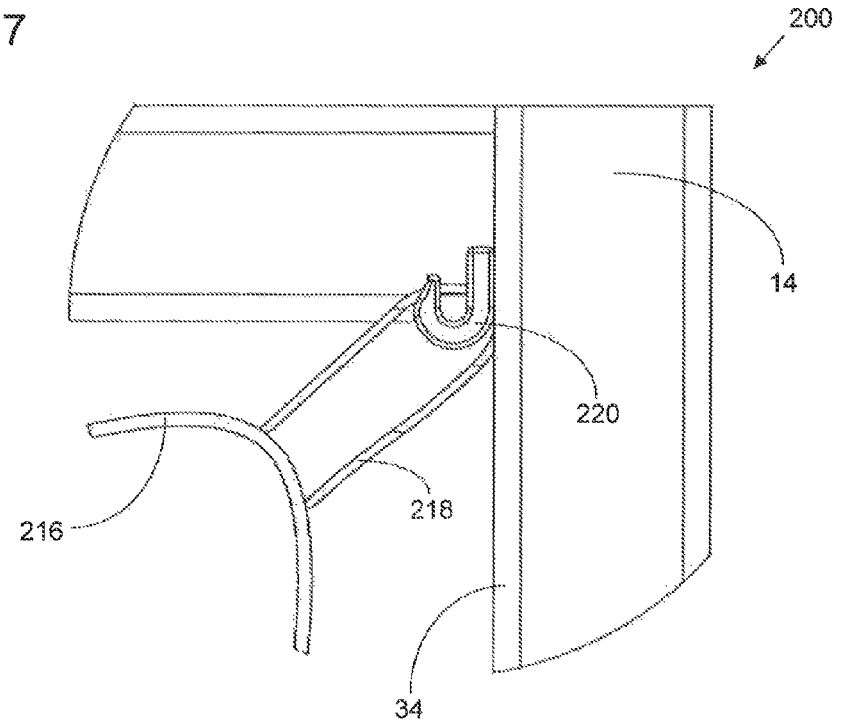
FIG. 7 is a section view showing liner suspension detail for the expandable holding tank illustrated in FIG. 6.
Figure 8:
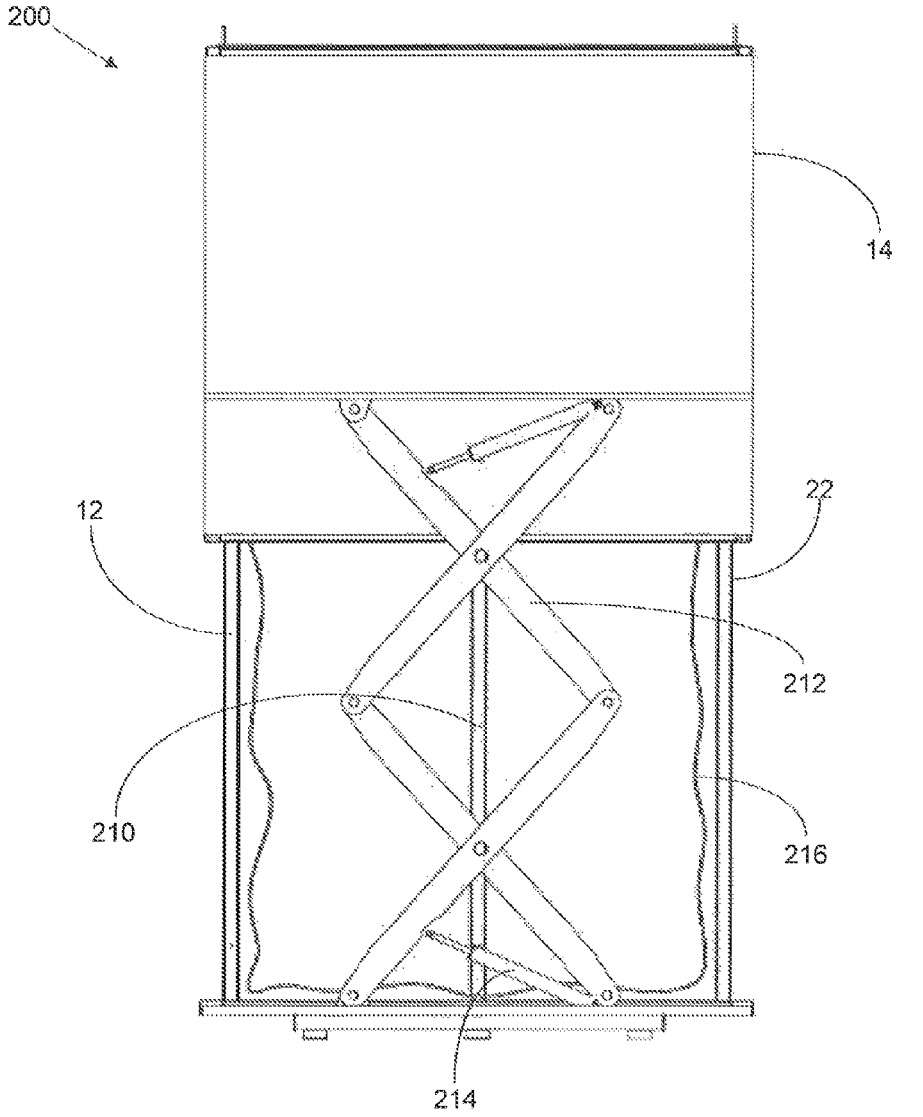
FIG. 8 is an end elevation view showing mechanical lift detail for the expandable holding tank illustrated in FIG. 6.

Variations:

Referring to FIG. 6 through FIG. 8, second embodiment 200 has been provided to discuss and illustrate variations that could be made to first embodiment 100, if desired. Except where new components have been introduced or components have been altered, components common to both first embodiment 100 and second embodiment 200 will be given identical reference numerals. In first embodiment 100, when second sidewall 14 nested with first sidewall 12, second sidewall 14 was inside of first sidewall 12 with interior face 24 of first sidewall 12 facing exterior face 32 of second sidewall 14. Referring to FIG. 8, in second embodiment 200, when second sidewall 14 nested with first sidewall 12, second sidewall 14 is outside of first sidewall 12 with exterior face 22 of first sidewall 12 facing interior face 34 of second sidewall 14. This variation is intended to show that it does not matter the relative positioning of first sidewall 12 and second sidewall 14.

With first embodiment 100, second sidewall 14 was moved to an operative position by lifting equipment and then maintained in the operative position by securing a plurality of fasteners to structural flanges provided by first seal component 42 and second seal component 44. In second embodiment 200, a drive mechanism, generally identified by reference numeral 210, has been provided to move second sidewall 14 from the stored position illustrated in FIG. 6 to the operative position illustrated in FIG. 8. Referring to FIG. 8, the particular form of drive mechanism 210 illustrated is a scissor lift 212 which is moved by hydraulic actuators 214 provided by hydraulic fluid from a hydraulic reservoir not shown). It will be appreciated that drive mechanism 210 may serve as a stop to maintain second sidewall 14 in the operative position. It is recognized that some drive mechanism 210 may be better than others at serving the dual purpose of a stop. This variation is intended to show that associated left mechanism can be provided and the means of maintaining second sidewall in the operative position may vary.

In the first embodiment 100, leakage was avoided by providing a leakage barrier 40 with a first seal component 42 being carried by first sidewall 12 and a second seal component 44 carried by second sidewall 14. Referring to FIG. 6 and FIG. 8, in the second embodiment 200 the leakage harrier is in the form of a flexible liner 216. Rather than focusing upon sealing a particular interface to prevent leakage, flexible liner 216 provides a leakage barrier for the entire liquid enclosure. Referring to FIG. 6 and FIG. 7, there is illustrated that flexible liner 216 is provided with loops 218. Loops 218 are engaged by hooks 220 positioned along interior surface 34 of second sidewall 14 to suspend flexible liner 216. This variation is intended to show that the type of liquid barrier used to prevent leaking may vary.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. An expandable holding tank, comprising:

a base supporting a first sidewall to define a liquid retaining enclosure, the first sidewall having an exterior face, an interior face, an upper edge and a lower edge;

a second sidewall positioned adjacent to the first sidewall, the second sidewall having an exterior face, an interior face, an upper edge and a lower edge;

a drive mechanism that selectively moves the second sidewall up and down one of the exterior face or the interior face of the first sidewall from a stored position to an operative position, in the stored position the second sidewall is nested with the first sidewall to position the lower edge of the second sidewall adjacent to the base, in the operative position the second sidewall is telescopically extended relative to the first sidewall to place the lower edge of the second sidewall at a distance from the base and the upper edge of the second sidewall extending above the upper edge of the first sidewall;

a continuous peripheral first seal component carried by the first sidewall and positioned along or in proximity to the upper edge of the first sidewall, and a continuous peripheral second seal component carried by the second sidewall and positioned along or in proximity to the lower edge of the second sidewall, wherein the peripheral first seal component and the peripheral second seal component comprise structural flanges;

in the operative position, the peripheral second seal component is adjacent to the peripheral first seal component;

a connection comprising threaded fasteners that sealably connects the peripheral first seal component and the peripheral second seal component when the second sidewall is in the operative position, to form a leakage barrier to prevent leakage between the first sidewall and the second sidewall, the threaded fasteners applying a compressive force to the peripheral first seal component and the peripheral second seal component, the threaded fasteners being oriented vertically, and a stop to selectively maintain the second sidewall in the operative position.

2. The expandable holding tank of claim 1, wherein a removable cover is supported by the upper edge of the second sidewall.

3. The expandable holding tank of claim 1, wherein the base is mounted on a transport skid.

4. The expandable holding tank of claim 1, wherein the leakage barrier comprises:

the continuous peripheral first seal component is positioned along or in proximity to the upper edge of first sidewall; and the continuous peripheral second seal component is positioned along or in proximity to the lower edge of the second sidewall;

such that when the second sidewall is raised to the operative position, the peripheral second seal component is brought into sealing engagement with the peripheral first seal component to form a liquid seal.

5. The expandable holding tank of claim 4, wherein the peripheral first seal component and the peripheral second seal component are structural flanges.

6. The expandable holding tank of claim 1, further comprising a flexible liner suspended along the upper edge of the second sidewall and positioned within the enclosure.

7. The expandable holding tank of claim 1, wherein the drive mechanism serves as the stop to maintain the second sidewall in the operative position.

8. The expandable holding tank of claim 1, wherein the drive mechanism is a scissor lift.

9. The expandable holding tank of claim 1, wherein the drive mechanism is a scissor lift that has hydraulic actuators.

10. The expandable holding tank of claim 1, wherein further comprising an additional compressible seal that is compressed by the threaded fasteners against the peripheral first seal component and the peripheral second seal component.

11. The expandable holding tank of claim 10, wherein a sealing gasket is positioned between the peripheral first seal component and the peripheral second seal component.

12. The expandable holding tank of claim 10, wherein the threaded shafts of the threaded fasteners extend through the openings in the peripheral first seal component to engage the threaded fastener receptacles of the peripheral second seal component and the heads of the threaded fasteners engage the peripheral first seal component.

13. The expandable holding tank of claim 10, wherein the heads of the threaded fasteners are removably connected to the threaded fasteners, the threaded fasteners are integrally formed with the threaded fastener receptacles of the peripheral second seal component, and the threaded shafts of the threaded fasteners extend through the openings in the peripheral first seal component and connected with the heads of the threaded fasteners.

14. The expandable holding tank of claim 1, wherein:

the peripheral second seal component comprises threaded fastener receptacles;

the peripheral first seal component comprises openings; and the fasteners comprises threaded fasteners, and the threaded fasteners comprising a head and a threaded shaft; and the openings in the peripheral first seal component is sized to allow the threaded shafts of the threaded fasteners to pass through the openings and to prevent the heads of the threaded fasteners from passing through the openings.

* * * * *